United States Patent [19]

Ogura

[11] 4,278,915

[45] Jul. 14, 1981

[54] MAGNETRONS

[75] Inventor: Toshio Ogura, Mobara, Japan

[73] Assignee: Hitachi, Ltd., Tokyo, Japan

[21] Appl. No.: 85,636

[22] Filed: Oct. 17, 1979

[30] Foreign Application Priority Data

Oct. 25, 1978 [JP] Japan ..... 53-145821[U]

[51] Int. Cl.[3] ..... H01J 25/50

[52] U.S. Cl. ..... 315/39.71; 315/39.51; 315/39.75

[58] Field of Search ..... 315/39.71, 39.75, 39.51

[56] References Cited

U.S. PATENT DOCUMENTS

| | | | |
|---|---|---|---|
| 3,987,333 | 10/1976 | Nakada et al. | 315/39.71 |
| 4,042,851 | 8/1977 | Yasuoka et al. | 315/39.51 |
| 4,071,804 | 1/1978 | Koinuma et al. | 315/39.71 |
| 4,075,534 | 2/1978 | Saito et al. | 315/39.75 |
| 4,163,175 | 7/1979 | Tashiro | 315/39.71 |
| 4,177,402 | 12/1979 | Ishida | 315/39.71 |

FOREIGN PATENT DOCUMENTS

| | | | |
|---|---|---|---|
| 50-83396 | 1/1977 | Japan | 315/39.71 |

*Primary Examiner*—Saxfield Chatmon
*Attorney, Agent, or Firm*—Charles E. Pfund

[57] ABSTRACT

In a magnetron of the type wherein magnetic flux of opposing permanent magnets is passed axially through an interaction space by way of pole pieces attached to opposing surfaces of the permanent magnets, at least one pole piece on the output side is constructed to contact the output side permanent magnet through annular contact surface.

1 Claim, 3 Drawing Figures

MAGNETRONS

BACKGROUND OF THE INVENTION

This invention relates to a magnetron, more particularly, a magnetic circuit of a magnetron of the type containing permanent magnets in its evacuated container.

When incorporated into a microwave oven, a magnetron generates a microwave output with high efficiencies and is therefore used widely for defrosting and heating foodstuffs.

While a prior art magnetron typically includes permanent magnets located on the outside of an evacuated container, a magnetron of the other type has also been proposed in which permanent magnets are contained in an evacuated container for the purpose of reducing size, weight and cost of manufacturing.

The prior art of the latter type has however disadvantages as described below. During the operation of the magnetron, a microwave is generated in the magnetron tube, which increases especially when the load is reflective. For this reason, should the microwave prevail in gaps between component elements or at portions where the joints between the elements are not perfect, electric sparks may occur, resulting in local heating and gas generation. As a consequence, the degree of vacuum in the magnetron tube is decreased, thus causing it to operate abnormally. This phenomenon occurs especially between the upper permanent magnet and its pole piece on the output (or antenna) side of the magnetron. Usually, the pole piece has a top surface overall area of which is in direct contact with the bottom surface of the upper permanent magnet for the purpose of establishing uniform field efficiently in the interaction space. To assure perfect contact with the magnet, the top surface or contact surface of the pole piece should be a flat surface of high flatness. Of course, no foreign matter should be present between the contacting surfaces. However, the construction of the prior art pole piece is difficult to meet hight flatness and prone to intimacy with foreign matters.

SUMMARY OF THE INVENTION

It is an object of this invention to provide an improved magnetron capable of eliminating various disadvantages described above and improving the reliability of the magnetron.

According to this invention, there is provided a magnetron of the type comprising a cylindrical anode electrode, a cathode electrode disposed along a central axis of the anode electrode, the anode electrode having a plurality of vanes secured to an inner surface of the cylinder and extending radially and inwardly toward the cathode electrode to define an interaction space between the cathode electrode and inner ends of the vanes, a pair of permanent magnets disposed at both ends of the interaction space, and pole pieces mounted on opposing surfaces of the permanent magnets for passing magnetic flux of the permanent magnets axially through the interaction space, wherein at least one pole piece mounted to the permanent magnet on the output side of the magnetron has an annular contact surface contacting the opposing surface of the associated permanent magnet.

DESCRIPTION OF THE PREFERRED EMBODIMENTS

Figure 1:
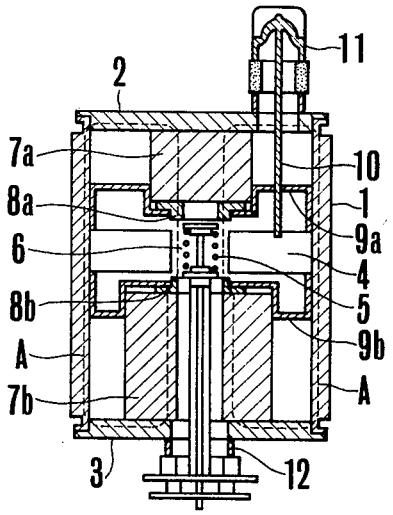
FIG. 1 is a longitudinal sectional view showing a magnetron embodying the invention.

As shown in FIG. 1, a magnetron of the type containing permanent magnets in its evacuated container and embodying the invention comprises a cylindrical anode electrode 1, upper and lower end plates 2 and 3 at the opposite ends of the anode electrode, which constitute essential portions of an evacuated container. In this container a plurality of vanes 4 which extend radially from the inner wall of the anode electrode 1 toward the central axis thereof, a cathode electrode 5 disposed along the axis concentrically with the anode electrode, a pair of permanent magnets 7*a* and 7*b* with pole pieces 8*a* and 8*b* for supplying uniform magnetic flux to an interaction space 6 defined between the inner ends of the vanes 4 and the cathode electrode 5, magnet holders 9*a* and 9*b* for holding the permanent magnets and their pole pieces at predetermined positions and an antenna 10 connected to a specific one of the vanes 4 for sending a microwave output to the outside of the evacuated container. An output dome 11 is mounted on the upper plate 2, while a stem 12 is connected to the lower plate 3.

The magnet holder 9*a* has a recessed cylindrical portion provided with a central opening in which the pole piece 8*a* of the magnet 7*a* is secured. The magnet holder 9*b* is constructed similarly. The magnet holders 9*a* and 9*b* should be made of nonmagnetic material in order to prevent short circuiting of the magnetic flux and leakage of the flux.

The magnetic flux flowing between the permanent magnets 7*a* and 7*b* passes throuth a path shown by dotted lines A in FIG. 1 to establish a uniform flux distribution in the interaction space 6.

Figure 2:
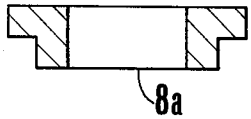
FIG. 2 is a sectional view showing, in exaggerated form, the upper pole piece used in the magnetron of FIG. 1.

It will be seen from FIG. 1 that the upper pole piece 8*a* has a top surface whose central, relatively large area is removed. More particularly, the upper pole piece 8*a* embodying the invention and exaggratedly shown in FIG. 2 generally takes the form of a cylinder. With this construction, the pole piece contacts the bottom surface of the upper permanent magnet 7*a* with smaller contact area than the prior art pole piece having the top surface with its central area not removed. As a consequence, the area of the contact surface which should be finished flat as far as possible decreases to about one half of that of the prior art pole piece. Further, decrease in the area of the contact surface between the permanent magnet and the pole piece decreases the chance of depositing foreign matters between the contact surfaces, thus decreasing sparks.

Figure 3:
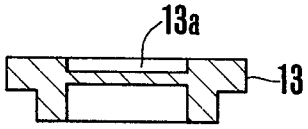
FIG. 3 is a sectional view showing another example of the upper pole piece.

In a modified pole piece 13 shown in FIG. 3, a central part of the top surface is recessed. Thus, a circular recess 13*a* is formed in the top surface of the pole piece so that the modified pole piece generally takes the form of a tube with one end opposing the associated permanent magnet closed and with the recess 13*a* formed in the one end. With this modification, the same advantages as those of the cylindrical pole piece can be enjoyed.

Although only the improved upper pole piece was shown and described, it should be understood that the modification of FIG. 3 may be applied to the lower pole piece.

What is claimed is:

1. In a magnetron of the type comprising a cylindrical anode electrode, a cathode electrode disposed along a central axis of said anode electrode, said anode electrode having a plurality of vanes secured to an inner surface of the cylinder and extending radially and inwardly toward said cathode electrode to define an interaction space between the cathode electrode and inner ends of said vanes, a pair of permanent magnets disposed at both ends of said interaction space, and pole pieces mounted on opposing surfaces of said permanent magnets for passing magnetic flux of said permanent magnets axially through said interaction space, the improvement wherein at least one pole piece mounted to the permanent magnet on the output side of the magnetron has an annular contact surface contacting the opposing surface of the associated permanent magnet and generally takes the form of a tube with one end closed and with a recess formed in the one end, said one end opposing the associated permanent magnet.

* * * * *

UNITED STATES PATENT AND TRADEMARK OFFICE

CERTIFICATE OF CORRECTION

PATENT NO. : 4,278,915
DATED : July 14, 1981
INVENTOR(S) : Toshio Ogura

It is certified that error appears in the above—identified patent and that said Letters Patent is hereby corrected as shown below:

col. 2, line 19: after "container" add--are contained--

Signed and Sealed this

*Second* Day of *March 1982*

[SEAL]

*Attest:*

GERALD J. MOSSINGHOFF

*Attesting Officer* *Commissioner of Patents and Trademarks*